US008072288B2

(12) United States Patent
Yamauchi et al.

(10) Patent No.: US 8,072,288 B2
(45) Date of Patent: Dec. 6, 2011

(54) DIRECTIONAL COUPLER

(75) Inventors: Kazuhisa Yamauchi, Tokyo (JP); Masatoshi Nakayama, Tokyo (JP); Yasuhiro Onaka, Tokyo (JP); Tomokazu Hamada, Tokyo (JP); Satoru Ishizaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 169 days.

(21) Appl. No.: 12/531,553

(22) PCT Filed: Apr. 11, 2008

(86) PCT No.: PCT/JP2008/057164

§ 371 (c)(1),
(2), (4) Date: Sep. 16, 2009

(87) PCT Pub. No.: WO2008/129961

PCT Pub. Date: Oct. 30, 2008

(65) Prior Publication Data

US 2010/0097160 A1 Apr. 22, 2010

(30) Foreign Application Priority Data

Apr. 16, 2007 (JP) ..... 2007-107279

(51) Int. Cl.
*H01P 5/18* (2006.01)
*H01P 5/16* (2006.01)

(52) U.S. Cl. ..... 333/109; 333/128

(58) Field of Classification Search ..... 333/109, 333/110, 111, 112, 115, 116, 128
See application file for complete search history.

(56) References Cited

U.S. PATENT DOCUMENTS

| | | | | |
|---|---|---|---|---|
| 4,310,814 | A | 1/1982 | Bowman | |
| 5,504,465 | A * | 4/1996 | Yung et al. | 332/145 |
| 2002/0140518 | A1 | 10/2002 | Verghese | |

FOREIGN PATENT DOCUMENTS

| | | |
|---|---|---|
| JP | 52 6058 | 1/1977 |
| JP | 57 21102 | 2/1982 |
| JP | 9-246818 | 9/1997 |
| JP | 11 17464 | 1/1999 |
| JP | 11-17464 | 1/1999 |
| JP | 2005 236449 | 9/2005 |
| WO | 02 067367 | 8/2002 |

OTHER PUBLICATIONS

Office Action issued Feb. 16, 2011, in Korean Patent Application No. 10-2009-7019643.

Chen, J.-L. et al., "A High-Directivity Microstrip Directional Coupler With Feedback Compensation", IEEE, pp. 101-104 (2002).

* cited by examiner

*Primary Examiner* — Dean Takaoka
(74) *Attorney, Agent, or Firm* — Oblon, Spivak, McClelland, Maier & Neustadt, L.L.P.

(57) ABSTRACT

A directional coupler capable of improving a directionality of a directional coupler body including four terminals. The directional coupler includes a directional coupler body including the four terminals of an input port, an output port, a coupling port, and an isolation port; and a combiner for combining powers of an output signal of the coupling port and an output signal of the isolation port of the directional coupler body; and a directionality improving circuit for amplifying or attenuating at least one of the output signal of the coupling port and the output signal of the isolation port before outputting the same, and the combiner combines powers of the output signals amplified or attenuated by the directionality improving circuit.

15 Claims, 12 Drawing Sheets

(A) WITH DIRECTIONALITY IMPROVING CIRCUIT (B) WITHOUT DIRECTIONALITY IMPROVING CIRCUIT (a)

| ELECTRIC LENGTH | 1/4 WAVELENGTH | 1/32 WAVELENGTH |
|---|---|---|
| AMPLITUDE DIFFERENCE | 2.84dB | 0.09dB |
| PHASE DIFFERENCE | 0.12deg | 0.03deg |

FREQUENCY BAND WIDTH 1.9GHz±0.3GHz (b)

DIRECTIONAL COUPLER

TECHNICAL FIELD

The present invention relates to a directional coupler. In particular, the present invention relates to a directional coupler including a circuit for improving a directionality of an existing directional coupler.

BACKGROUND ART

A directional coupler is used as a microwave circuit for separating a progressive wave from a reflected wave in various fields. In an ideal directional coupler, the progressive wave and the reflected wave are completely separated from each other, and hence only the progressive wave appears at a coupling port while only the reflected wave is generated at the isolation port. Therefore, a directionality that is a power ratio between the progressive wave and the reflected wave becomes infinite.

If a high directionality is desired to be realized, it is necessary to match phase speeds of even and odd modes. However, a microstrip line that is widely used as a micro circuit is a heterogeneous medium line, and hence a difference in wavelength shortening ratio occurs between the even mode and the odd mode. Therefore, the reflected wave may leak out to the coupling port, which causes a problem that the directionality expressed by a difference between a power generated at the coupling port and a leakage power at the isolation port is deteriorated.

Therefore, some methods have been proposed for improving the directionality, which includes a method of providing a feedback line (see, for example, Non-patent Document 1), a method of processing portions of a main line and a coupling line facing each other (see, for example, Patent Document 1), a method of providing a floating conductor to a coupling portion of the coupling line (see, for example, Non-patent Document 2), and the like.

FIG. 10 is a schematic diagram of a conventional directional coupler in Non-patent Document 1. The directional coupler in Non-patent Document 1 includes feedback lines 103 and 104, which are respectively disposed between input and output terminals of a main line 101, and between the isolation port 108 and the coupling port 107, and hence the directionality is improved.

More specifically, the improvement of the directionality is intended as follows. The main line 101 and a coupling line 102 facing each other are connected to the feedback lines 103 and 104, respectively. An RF signal received from an input terminal 105 is led to an output terminal 106 via the main line 101. Further, the main line 101 is coupled with the coupling line 102, and hence the signal received from the input terminal 105 is led to the coupling port 107.

Then, the phase speeds of the even mode and the odd mode are matched with each other by the feedback lines 103 and 104. Thus, the signal is not led to an isolation port 108, and hence the improvement of the directionality is intended.

In addition, FIG. 11 is a schematic diagram of a conventional directional coupler in Patent Document 1. This directional coupler of Patent Document 1 improves the directionality by disposing portions 115 and 116 at both ends of the coupling portion of a coupling line 110 so as to increase capacitance of a main line 119, and by letting facing portions 117 of the main line 119 and the coupling line 110 have inductances.

More specifically, the improvement of the directionality is intended as follows. A coupling portion 118 of the main line 119 and the coupling line 110 has portions 115 and 116 for increasing capacitance of the main line 119 at both ends of the coupling line 110, and a portion for having inductance at the facing portions 117 of the main line 119 and the coupling line 110. An RF signal received from an input terminal 111 is led to an output terminal 112 via the main line 119.

Further, the main line 119 is coupled with the coupling line 110, and hence the signal received from the input terminal 111 is led to a coupling port 113. The directional coupler of Patent Document 1 makes phase speeds of the even mode and the odd mode match with each other by means of the portions 115 and 116 that increase the capacitance of the main line 119 and are disposed on both ends of the coupling portion 118 of the coupling line 110, and the facing portions 117 of the main line 119 and the coupling line 110 having inductance. Thus, the signal is prevented from being led to an isolation port 114, and hence improvement of the directionality is intended.

In addition, FIG. 12 is a schematic diagram of a conventional directional coupler in Non-patent Document 2. This directional coupler in Non-patent Document 2 compensates for a phase difference between the even mode and the odd mode by providing floating conductors 127 to a coupling portion of a coupling line 126, and hence the directionality is improved.

More specifically, the improvement of the directionality is intended as follows. The floating conductors 127 are disposed in a coupling portion of a main line 125 and the coupling line 126. An RF signal received from an input terminal 121 is led to an output terminal 122 through the main line 125. Further, the main line 125 is coupled with the coupling line 126, and hence the signal received from the input terminal 121 is led to a coupling port 123.

Then, periodical slits provided to the coupling portion increase a distributed inductance of the odd mode mainly. In addition, the floating conductor inserted in the coupling portion affects almost only distributed capacitance of the odd mode. Therefore, the phase speeds of the even mode and the odd mode can be matched with each other by adjusting sizes of the slit and the floating conductors 127. Thus, it is possible to prevent the signal from being led to an isolation port 124, and hence the improvement of the directionality is intended.

PATENT DOCUMENT 1

JP 56-138302 A

Non-patent Document 1: Jia-Liang Chen, Sheng-Fuh Chang, and Chain-Tin Wu, "A High-Directivity Microstrip Directional Coupler With Feedback Compensation," TU2E-2, pp. 101-104, IEEE IMS2002

Non-patent Document 2: Fujii, Kokubo, and Ohta, "Directivity Improvement ¼ Microstrip Couplers with Periodic Floating-Conductors on Coupled Edges," C-2-51-2006 Society Conference of the Institute of Electronics, Information and Communication Engineers

DISCLOSURE OF THE INVENTION

Problems to be Solved by the Invention

However, the conventional techniques have following problems.

Each of the conventional directional couplers described above is required to be designed so that the directionality becomes optimal at a predetermined frequency when the directional coupler is designed. As a result, there is a problem that if the directionality is deteriorated because of a manufacturing fluctuation of the substrate, expansion of the substrate due to temperature, an error in designing accuracy, or the like, correction thereof is impossible. In addition, there is a problem that it is necessary to change the design of the directional coupler body in the designing stage, and hence the directionality of an existing directional coupler cannot be improved.

The present invention has been made to solve the problems described above, and an object thereof is to obtain a directional coupler that is capable of improving a directionality of a directional coupler body including four terminals.

Means for Solving the Problems

The present invention provides a directional coupler comprising: a directional coupler body including four terminals of an input port, an output port, a coupling port, and an isolation port; and a combiner for combining powers of an output signal of the coupling port and an output signal of the isolation port of the directional coupler body, in which: the directional coupler further comprises a directionality improving circuit for amplifying or attenuating at least one of the output signal of the coupling port and the output signal of the isolation port before outputting the same; and the combiner combines powers of the output signals amplified or attenuated by the directionality improving circuit.

EFFECT OF THE INVENTION

According to the present invention, a directionality improving circuit is provided for amplifying or attenuating at least one of the output signal of the coupling port and the output signal of the isolation port, and hence it is possible to obtain the directional coupler that is capable of improving the directionality of the directional coupler body including four terminals.

BEST MODES FOR CARRYING OUT THE INVENTION

Preferred embodiments of a directional coupler according to the present invention are described below with reference to the drawings. The directional coupler according to the present invention has a technical feature that the directional coupler includes a directionality improving circuit is connected to one or both of a coupling port and an isolation port of the directional coupler body.

Embodiment 1

Figure 1:
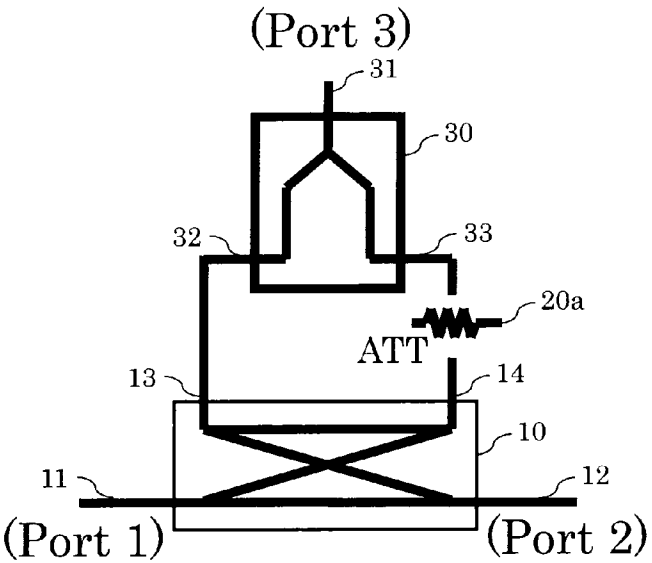
FIG. 1 is a schematic diagram of a directional coupler according to Embodiment 1 of the present invention.
Figure 2:
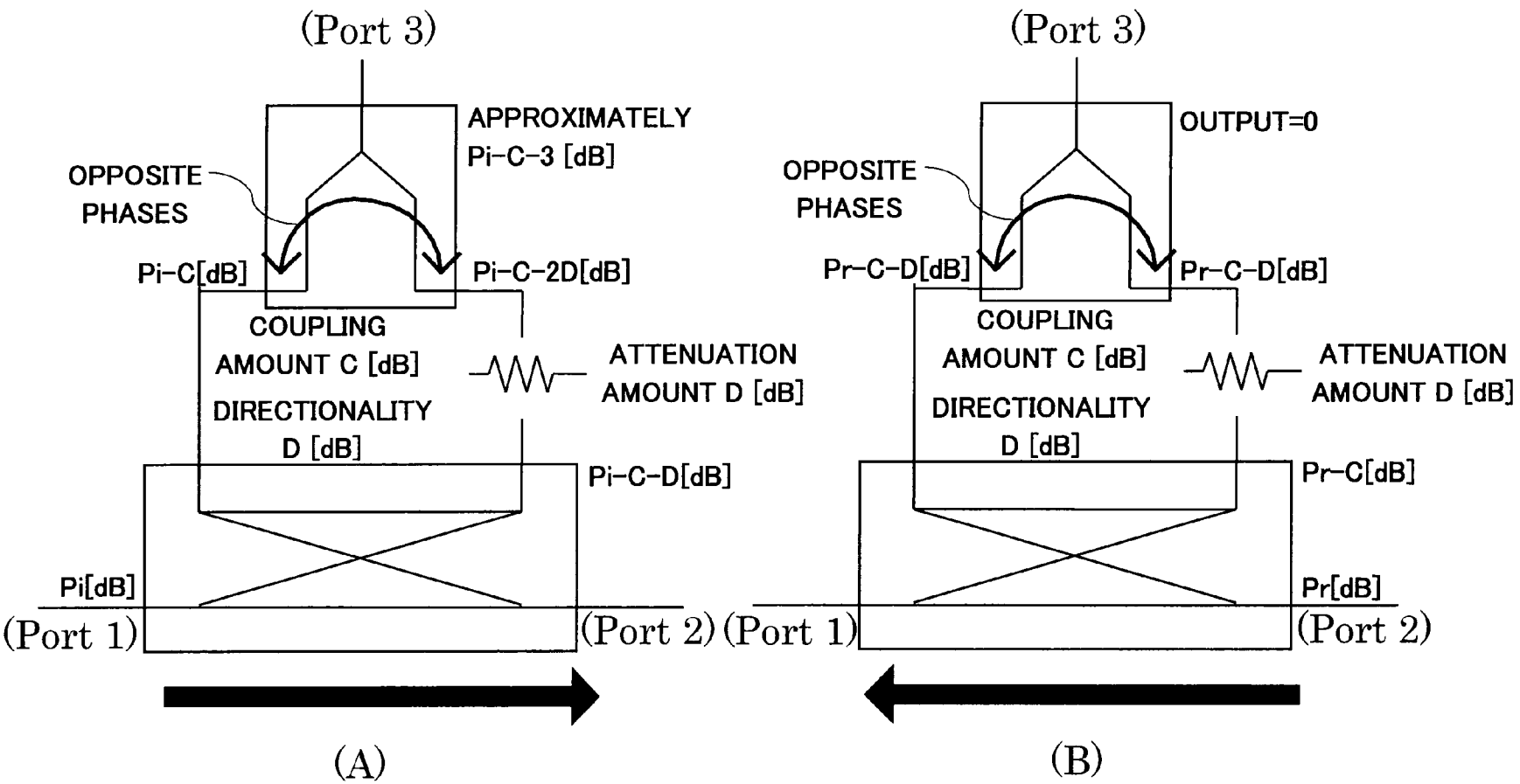
FIG. 2 are operation explanatory diagrams of the directional coupler according to Embodiment 1 of the present invention.

FIG. 1 is a schematic diagram of the directional coupler according to Embodiment 1 of the present invention. In addition, FIG. 2 are operation explanatory diagrams of the directional coupler according to Embodiment 1 of the present invention. The directional coupler according to Embodiment 1 includes a directional coupler body 10, an attenuator 20*a* that corresponds to a directionality improving circuit, and a combiner 30.

In addition, the directional coupler body 10 includes four terminals 11 to 14. The terminal 11 corresponds to an input terminal and is denoted by Port 1 in FIG. 1. In addition, the terminal 12 corresponds to an output terminal and is denoted by Port 2 in FIG. 1. Further, the terminal 13 corresponds to a coupling port, and the terminal 14 corresponds to an isolation port.

On the other hand, the combiner 30 includes three terminals 31 to 33, so as to combine powers of signals received from the terminal 32 and the terminal 33, respectively. The combined signal is outputted from the terminal 31 (denoted by Port 3 in FIG. 1).

The coupling port 13 of the directional coupler body 10 is connected to the terminal 32 of the combiner 30. On the other hand, the isolation port 14 of the directional coupler body 10 is connected to the terminal 33 of the combiner 30 via the attenuator 20*a*.

Next, an operation of the directional coupler in Embodiment 1 is described. Note that the directional coupler body 10 in Embodiment 1 is a ¼ wavelength directional coupler.

First, a case of receiving the signal from the terminal 11 is described with reference to FIG. 2(A). The RF signal (Pi (dB)) received from the terminal 11 passes through the directional coupler body 10 and afterward is led to the terminal 12. On this occasion, when a coupling amount is denoted by C (dB), and the directionality is denoted by D (dB), a coupling power (Pi−C (dB)) is generated at the coupling port 13, and a power that is smaller than the power generated at the coupling port 13 by the directionality and has the opposite phase (Pi−C−D (dB)) leaks out to the isolation port 14.

The signal leaking out to the isolation port 14 is attenuated by the attenuator 20*a* that is set to have an amplitude value (D (dB)) that is the same as the directionality of the directional coupler body 10, and afterward its power is combined with a power of the signal from the coupling port 13 in the combiner 30. Here, one of the input signal of the combiner 30 is the signal outputted from the coupling port 13 (Pi−C (dB)), and the other is the signal that is outputted from the isolation port 14 and has passed through the attenuator 20*a* (Pi−C−2D (dB)).

Powers of the both signals are combined in opposite phases and different amplitudes by the combiner 30. Therefore, if a Wilkinson distributor is used as the combiner 30, the power P (dB) that is decreased to be lower than the power at the coupling port 13 and is expressed by the following expression (1) is generated at Port 3 of the combiner 30.

[Expression 1]

$$P=Pi-C-3+20\log(1-10^{-D/10}) \quad (1)$$

Next, the case where a signal outputted from the terminal 12 is reflected by an antenna or the like and returns to the terminal 12 is described with reference to FIG. 2(B). The reflected wave (Pr (dB)) that returns to the terminal 12 passes through the directional coupler body 10 and afterward is led to the terminal 11. On this occasion, a coupling power (Pr−C (dB)) is generated at the isolation port 14, and a power that is smaller than the power generated at the isolation port 14 by the directionality and has the opposite phase (Pr−C−D (dB)) leaks out to the coupling port 13.

The signal generated at the isolation port 14 is attenuated by the attenuator 20*a* having an attenuation amount that is set to be the same amplitude value (D (dB)) as the directionality of the directional coupler body 10 (Pi−C−D (dB)), and its power is combined with a power of the signal from the coupling port 13 (Pr−C−D (dB)) in the combiner 30. Here, the both signals have opposite phases and the same amplitude. Therefore, as for the reflected wave, no power is generated at the Port 3 of the combiner 30.

As a result, as to the power generated at the Port 3, it is understood that there is a large difference in power between the case where the signal enters from the terminal 11 and the case where the signal enters from the terminal 12. Therefore, by using the directional coupler of Embodiment 1 including the attenuator 20*a* that works as the directionality improving circuit, the directionality of the directional coupler body 10 can be improved.

In order to confirm the improvement of the directionality, a prototype of the directional coupler of Embodiment 1 was manufactured, and the improvement effect of the directionality was measured. In the experiment, the attenuator 20*a* having an amplitude value as the attenuation amount that is the same as the directionality (D (dB)) of the directional coupler body 10 was connected to the isolation port 14. Further, in addition to this, attenuators having the same attenuation amount were inserted in both the coupling port 13 and the isolation port 14 in order to prevent multiple reflection due to impedance mismatch between the directional coupler body 10 and the combiner 30.

Figure 3:
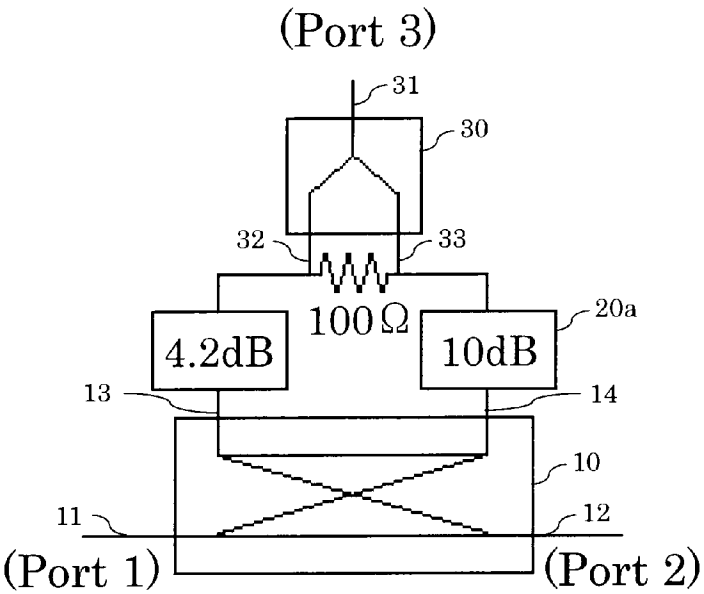
FIG. 3 is a circuit schematic diagram of a prototype directional coupler according to Embodiment 1 of the present invention.

FIG. 3 is a circuit schematic diagram of the prototype directional coupler according to Embodiment 1 of the present invention. FIG. 3 illustrates an example case where the attenuators are respectively connected to the isolation port 14 and the coupling port 13 of the directional coupler body 10, and the outputs thereof are combined by the Wilkinson distributor corresponding to the combiner 30.

Figure 4:
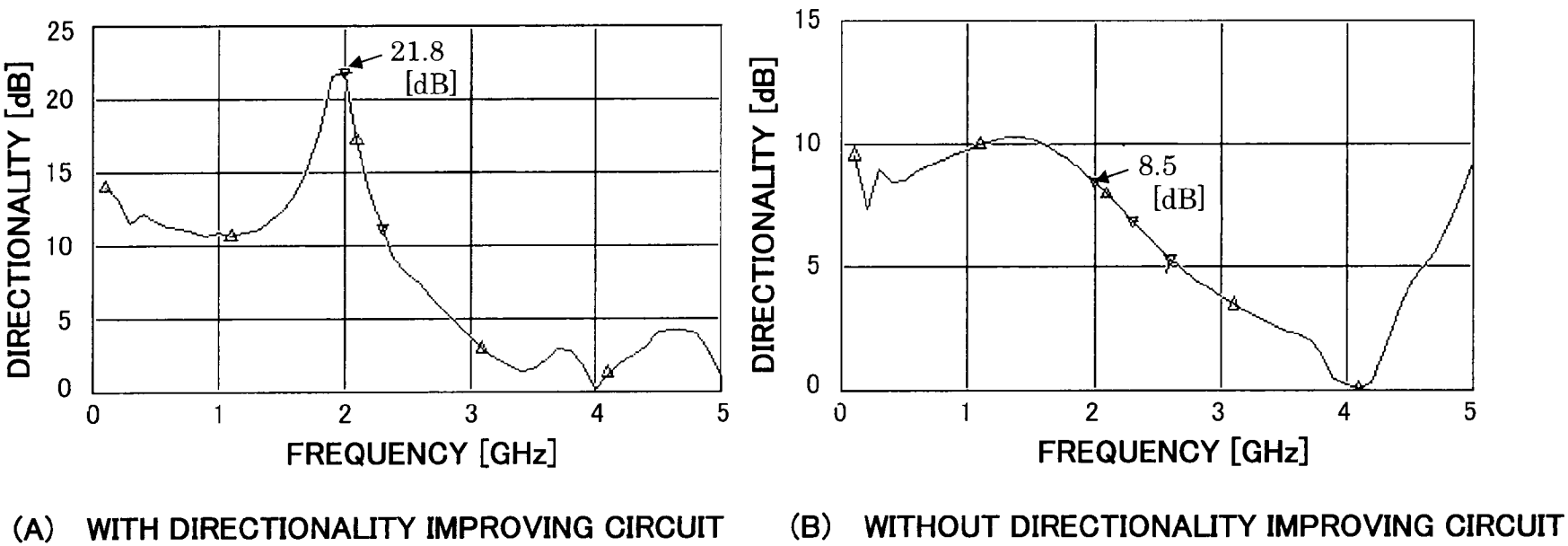
FIG. 4 are diagrams illustrating a result of measurement of a directionality of the prototype directional coupler according to Embodiment 1 of the present invention.

FIG. 4 are diagrams illustrating a result of measurement of the directionality of the prototype directional coupler according to Embodiment 1 of the present invention. FIG. 4(A) illustrates a result of measurement of the directionality in the case with directionality improving circuit, and FIG. 4(B) illustrates a result of measurement of the directionality in the case without the directionality improving circuit. For instance, the directionality at a frequency of 2 GHz is improved from 8.5 dB in FIG. 4(B) to 21.8 dB in FIG. 4(A), and hence the effectiveness of the directionality improving circuit can be confirmed.

As described above, according to Embodiment 1, the directionality of the directional coupler body can be improved by combining the signals outputted from the coupling port and the isolation port of the directional coupler body via the directionality improving circuit.

In particular, according to Embodiment 1, the attenuator is used as the directionality improving circuit, and hence it is easy to readjust the directionality to obtain an optimal directionality by adjusting the attenuator. In addition, it is also easy to change the frequency. Further, it is possible to improve the directionality of the existing directional coupler as well by adding the directionality improving circuit that is the technical feature of the present invention to the same.

Embodiment 2

Figure 5:
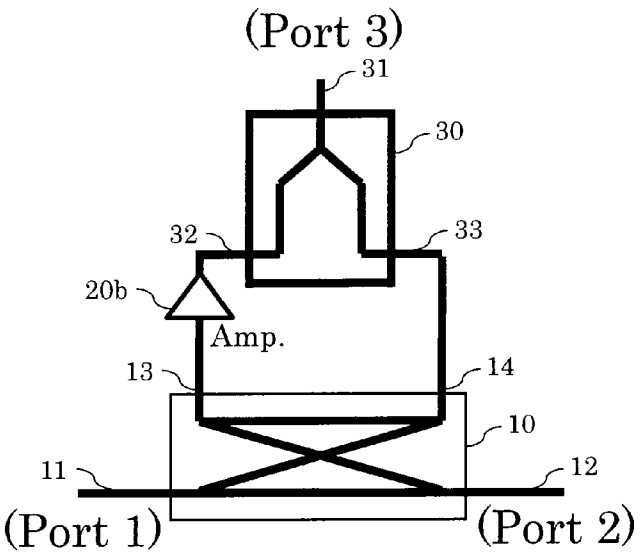
FIG. 5 is a schematic diagram of a directional coupler according to Embodiment 2 of the present invention.

FIG. 5 is a schematic diagram of the directional coupler according to Embodiment 2 of the present invention. In Embodiment 1 described above, the attenuator 20*a* is connected to the isolation port 14 as the directionality improving circuit. In contrast, Embodiment 2 is different from Embodiment 1 in that an amplifier 20*b* is connected to the coupling port 13 as the directionality improving circuit. This amplifier 20*b* has a gain of the amplitude value (D (dB)) that is the same as the directionality of the directional coupler body 10.

Further, powers of the signal outputted from the coupling port 13 via the amplifier 20*b* and the output of the isolation port 14 are combined with each other by the combiner 30.

In Embodiment 1 described above, the output of the isolation port 14 is attenuated by the attenuator 20*a* and afterward is used for the combining. In contrast, according to Embodiment 2, the output of the coupling port 13 is amplified by the amplifier 20*b* and afterward is used for the combining. Although the directionality improving circuits are different, the basic operation of the directional coupler in Embodiment 2 is the same as that of Embodiment 1 described above.

Next, an operation of the directional coupler in Embodiment 2 is described. Note that the directional coupler body 10 in Embodiment 2 is also a ¼ wavelength directional coupler similarly to Embodiment 1 described above.

Figure 6:
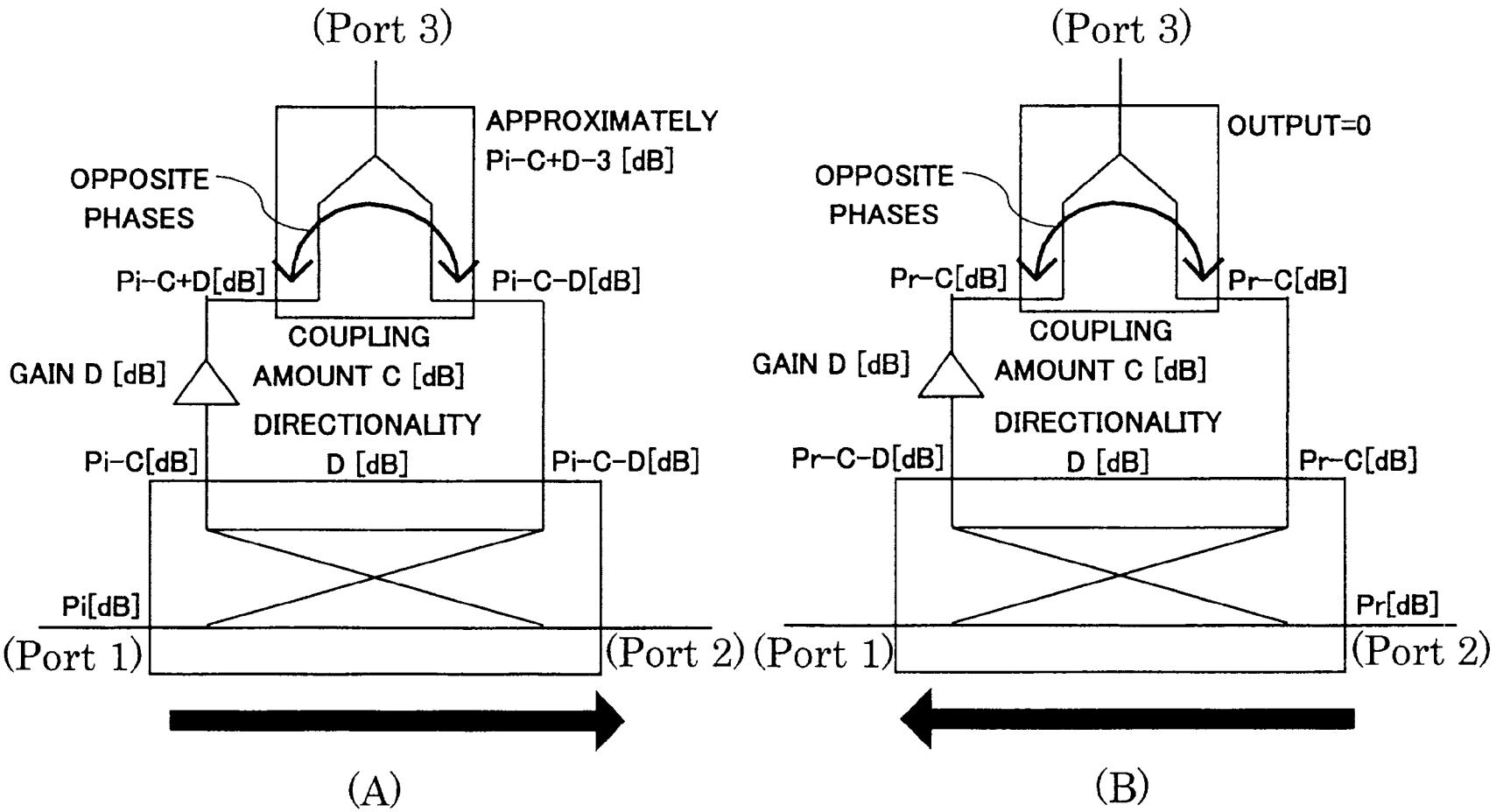
FIG. 6 are operation explanatory diagrams of the directional coupler according to Embodiment 2 of the present invention.

FIG. 6 are operation explanatory diagrams of the directional coupler in Embodiment 2 of the present invention. First, the case where the signal enters from the terminal 11 is described with reference to FIG. 6(A). The RF signal (Pi(dB)) received from the terminal 11 passes through the directional coupler body 10 and afterward is led to the terminal 12. In this case, if the coupling amount is denoted by C (dB), and the directionality is denoted by D (dB), then the coupling power (Pi−C (dB)) is generated at the coupling port 13, and a power that is smaller than the power generated at the coupling port 13 by the directionality and has the opposite phase (Pi−C−D (dB)) leaks out to the isolation port 14.

The signal of the coupling power generated at the coupling port 13 is amplified by the amplifier 20*b* having a gain of the amplitude value (D (dB)) that is the same as the directionality of the directional coupler body 10 (Pi−C+D (dB)), and afterward a power thereof is combined with a power of the signal from the isolation port 14 at the combiner 30.

Here, one of the signals entering the combiner 30 is the signal outputted from the coupling port 13 and passes through the amplifier 20*b* (Pi−C+D (dB)), and the other is the signal outputted from the isolation port 14 (Pi−C−D (dB)).

Powers of the both signals are combined by the combiner 30 in opposite phases and different amplitudes. Therefore, if the Wilkinson distributor is used as the combiner 30, the power P (dB) that is decreased to be lower than the power (Pi−C+D (dB)) outputted from the amplifier 20*a* and is expressed by the following expression (2) is generated at the Port 3 of the combiner 30.

[Expression 2]

$$P=Pi-C+D-3+20\log(1-10^{-D/10}) \quad (2)$$

Next, the case where the signal outputted from the terminal 12 is reflected by the antenna or the like and returns to the terminal 12 is described with reference to FIG. 6(B). The reflected wave (Pr (dB)) that returns to the terminal 12 passes through the directional coupler body 10 and afterward is led to the terminal 11. On this occasion, a coupling power (Pr−C (dB)) is generated at the isolation port 14, and a power that is smaller than the power generated at the isolation port 14 by the directionality and has the opposite phase (Pr−C−D (dB)) leaks out to the coupling port 13.

The signal generated at the coupling port 13 is amplified by the amplifier 20*b* having a gain set to be the amplitude value (D (dB)) that is the same as the directionality of the directional coupler body 10 (Pi−C (dB)), and a power thereof is combined with a power of the signal from the isolation port 14 (Pr−C (dB)) in the combiner 30. Here, the both signals have opposite phases and the same amplitude. Therefore, as for the reflected wave, no power is generated at the Port 3 of the combiner 30.

As a result, as to the power generated at the Port 3, it is understood that there is a large difference in power between the case where the signal enters from the terminal 11 and the case where the signal enters from the terminal 12. Therefore, by using the directional coupler of Embodiment 2 including the amplifier 20*b* that works as the directionality improving circuit, the directionality of the directional coupler body 10 can be improved similarly to the case of Embodiment 1 described above.

As described above, according to Embodiment 2, the directionality of the directional coupler body can be improved by combining the signals outputted from the coupling port and the isolation port of the directional coupler body via the directionality improving circuit.

In particular, the amplifier is used as the directionality improving circuit in Embodiment 2 so that the signal outputted from the coupling port is amplified by the amplifier, and hence it is possible to produce a power larger than that of Embodiment 1 described above by the gain of the amplifier. As a result, there is a merit that even when the coupling amount of the directional coupler body 10 is small, the power that appears at the terminal 31 does not become too small.

Further, there is a merit that a signal of good quality can be obtained because it is hardly interfered even when an unnecessary wave is generated in the case housing the directional coupler due to a large power applied to the terminal 11 or when a signal is induced in the substrate. Further, by using a variable gain amplifier as the amplifier, the frequency for improving the directionality can be adjusted easily.

Embodiment 3

Figure 7:
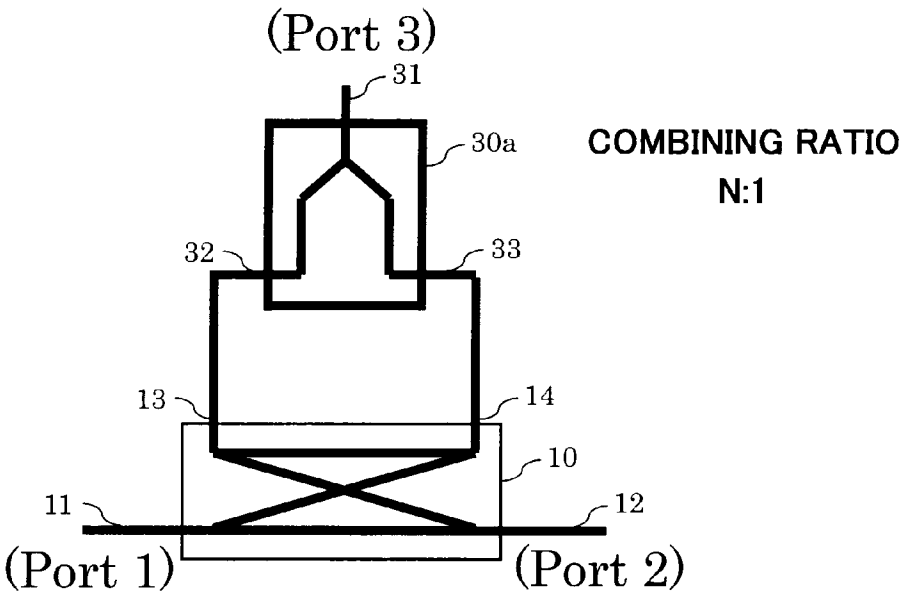
FIG. 7 is a schematic diagram of a directional coupler according to Embodiment 3 of the present invention.

FIG. 7 is a schematic diagram of the directional coupler according to Embodiment 3 of the present invention. In Embodiment 1 described above, the attenuator 20*a* is connected to the isolation port 14 as the directionality improving circuit. Further, in Embodiment 2 described above, the amplifier 20*b* is connected to the coupling port 13 as the directionality improving circuit.

In contrast, according to Embodiment 3, the outputs of the isolation port and the coupling port are connected to a combiner 30*a* for combining powers thereof by a combining ratio of the amplitude value (D (dB)) that is the same as the directionality of the directional coupler, so as to improve the directionality of the directional coupler body 10. In other words, the combiner 30*a* corresponds to a combiner with a directionality improving circuit, which includes two input terminals having different combining ratios and has a function of the attenuator as well that works as the directionality improving circuit.

The directional coupler of Embodiment 3 includes the directionality improving circuit incorporated in the combiner 30*a*, but the basic operation is the same as those of Embodiments 1 and 2 described above, and hence description thereof is omitted.

As described above, according to Embodiment 3, the directionality of the directional coupler body can be improved by combining the signals outputted from the coupling port and the isolation port of the directional coupler body via the directionality improving circuit.

In particular, Embodiment 3 uses the combiner having different combining ratios, and hence there is a merit that the combiner itself has the both functions of the attenuator and the combiner, thereby eliminating the need for an independent attenuator. As a result, there is a merit that the structure can be simplified.

Note that the directional coupler body that is used in Embodiments 1 to 3 described above can be constituted of microstrip lines. Thus, the directional coupler body and the directionality improving circuit can be formed on the same plane.

In addition, though Embodiments 1 to 3 described above exemplify the case where the ¼ wavelength directional coupler is used as the directional coupler body, it is possible to use a ½ wavelength directional coupler instead. If a coupling line length is an integral multiple of the ¼ wavelength, a large coupling amount can be obtained. In addition, if it is the ½ wavelength directional coupler, it is possible to improve the directionality of the directional coupler body without the directionality improving circuit.

In addition, the directional coupler body in Embodiments 1 to 3 described above may be one including an isolator connected to at least one of the coupling port and the isolation port. Thus, it is possible to suppress multiple reflection due to impedance mismatch between the directional coupler body and the combiner.

Further, it is possible to connect additionally a phase adjustment line to at least one of the coupling port and the isolation port as the directional coupler body of Embodiments 1 to 3 described above, so as to adjust a phase difference between a phase between the input terminals of the coupling port and the combiner, and a phase between the input terminals of the isolation port and the combiner.

Thus, a passing amplitude difference between the coupling port side and the isolation port side can be adjusted. Thus, even when the phases of the input signals at the input terminals of the combiner 30 do not have opposite, the passing amplitude difference can be adjusted.

Further, the attenuator having the attenuation amount as the amplitude value that is the same as the directionality of the directional coupler body of Embodiments 1 to 3 described above can include a plurality of attenuators.

If a common available resistor is used for constituting the attenuator, there is a problem that it is difficult to realize a desired attenuation amount accurately with one attenuator because resistance values are discrete values. Therefore, it is possible to combine a plurality of attenuators so that a desired attenuation amount can be realized accurately.

Thus, a passing amplitude difference between the coupling port side and the isolation port side can be adjusted more precisely. Thus, even when the amplitude of the input signals at the input terminals of the combiner 30 do not have the same amplitude, the passing amplitude difference can be adjusted.

Figure 8:
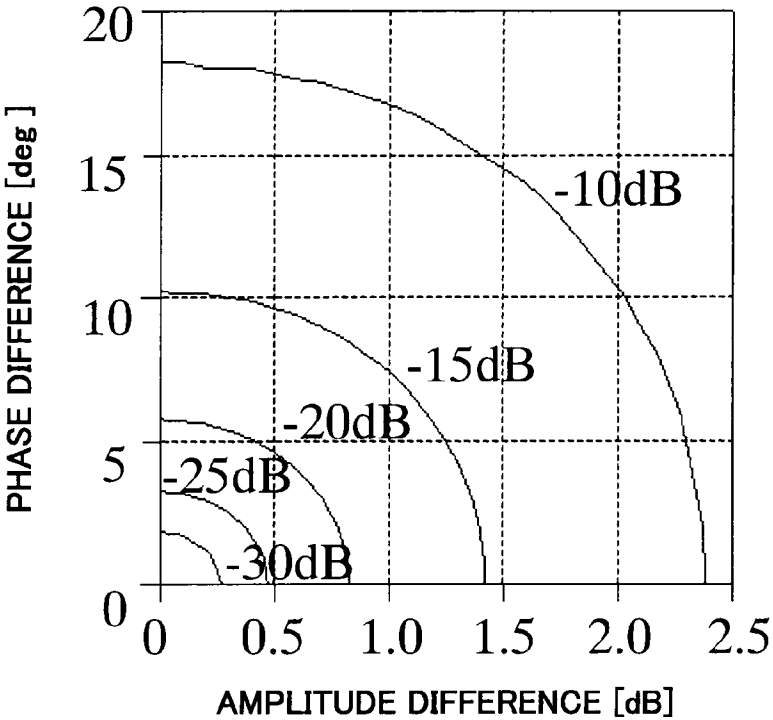
FIG. 8 is a diagram illustrating a cancelled amount in a combiner 30 according to Embodiment 3 of the present invention.

FIG. 8 is a diagram illustrating cancelled amounts in the combiner 30 according to Embodiment 3 of the present invention. More specifically, FIG. 8 illustrates cancelled amounts in the combiner with respect to the amplitude difference and the phase difference between the coupling port side and the isolation port side, in which curves indicate cancelled amounts corresponding to −10 dB, −15 dB, −20 dB, −25 dB, and −30 dB.

By the adjustment of the attenuation amount or the adjustment of the phase adjustment line length, the amplitude difference and the phase difference are decreased, and hence the cancelled amount can be improved. Thus, the directionality can be improved more, and a frequency band in which the directionality is improved can be widened.

In addition, as the directional coupler body of Embodiments 1 to 3 described above, a filter circuit may be connected additionally to at least one of the coupling port and the isolation port. In this filter circuit, a passing amplitude or a passing phase changes in accordance with a frequency. Therefore, such the filter circuit can compensate for the amplitude difference and the phase difference between the coupling port and the isolation port of the directional coupler body, which change in accordance with a frequency.

As a result, it is possible to realize a constant amplitude difference and a constant phase difference over a wide frequency range. Finally, in the directional coupler of Embodiments 1 to 3, it is possible to widen the frequency band in which a good directionality can be obtained.

In addition, Embodiments 1 to 3 described above exemplify the case where the ¼ wavelength directional coupler is used as the directional coupler body. However, a directional coupler of a wavelength shorter than or equal to the ¼ wavelength may be used as the directional coupler body.

Figure 9:
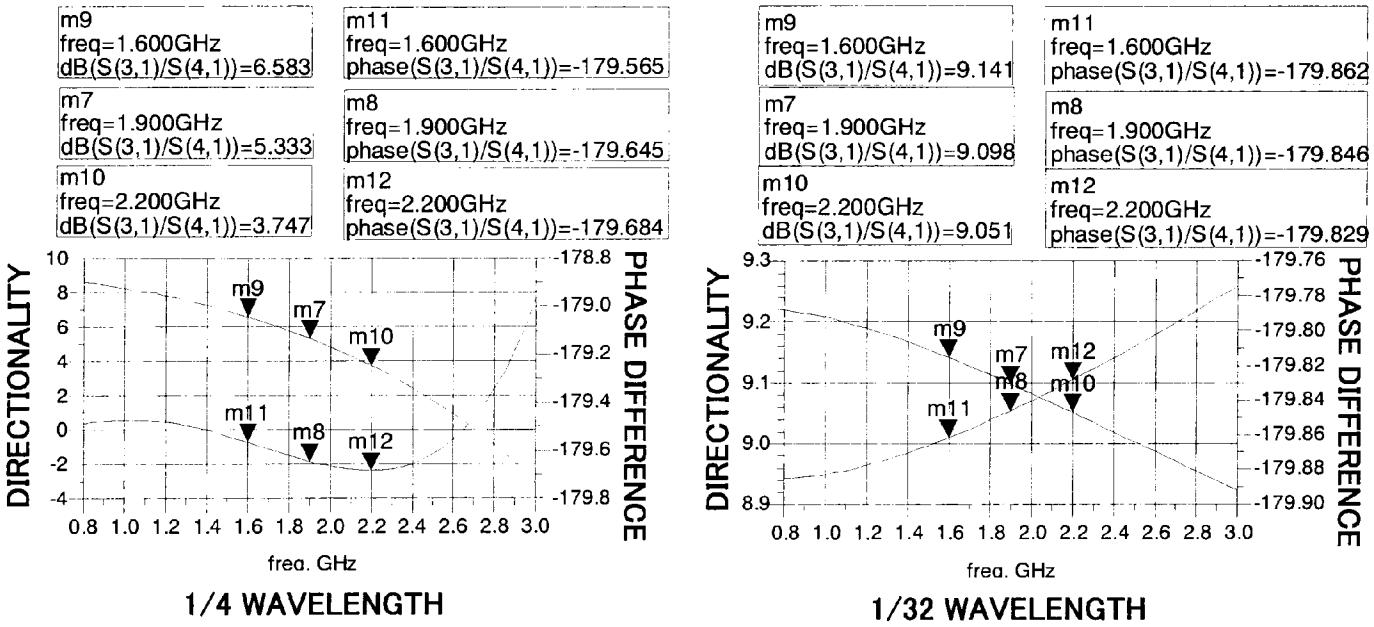
FIG. 9 are diagrams illustrating a result of computation of a directionality and a phase difference of the directional coupler according to Embodiment 3 of the present invention.
Figure 10:
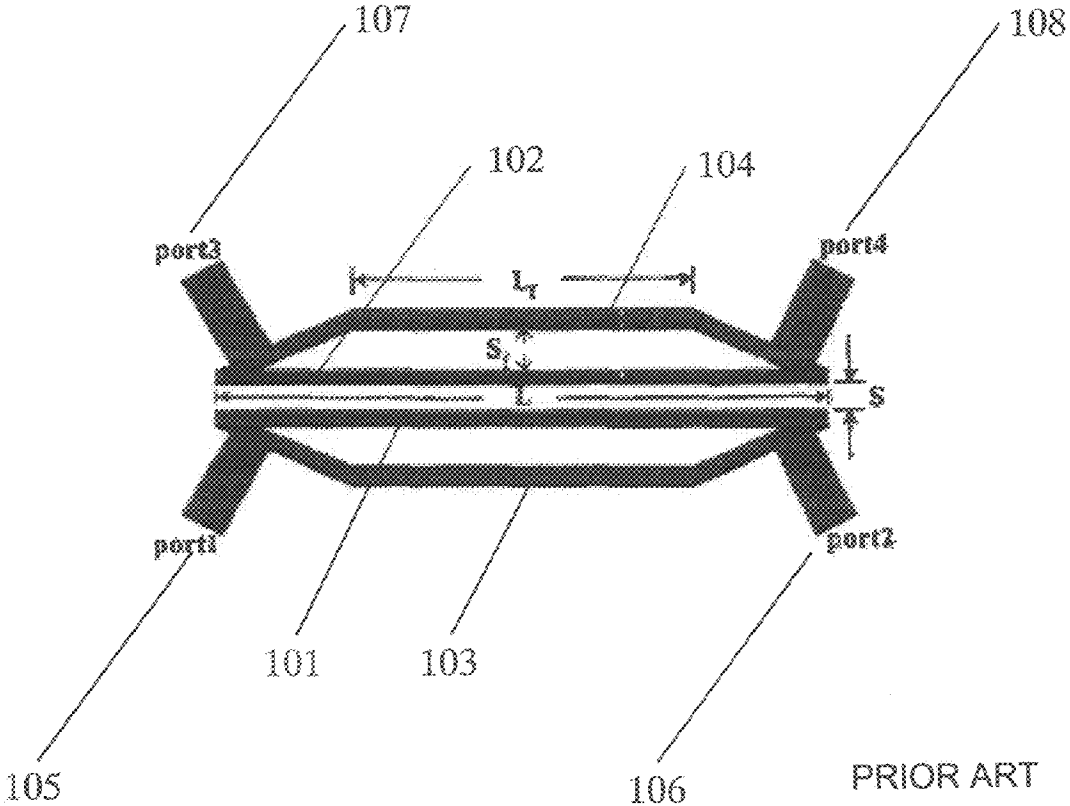
PRIOR ART FIG. 10
FIG. 10 is a schematic diagram of a conventional directional coupler according to Non-patent Document 1.
Figure 11:
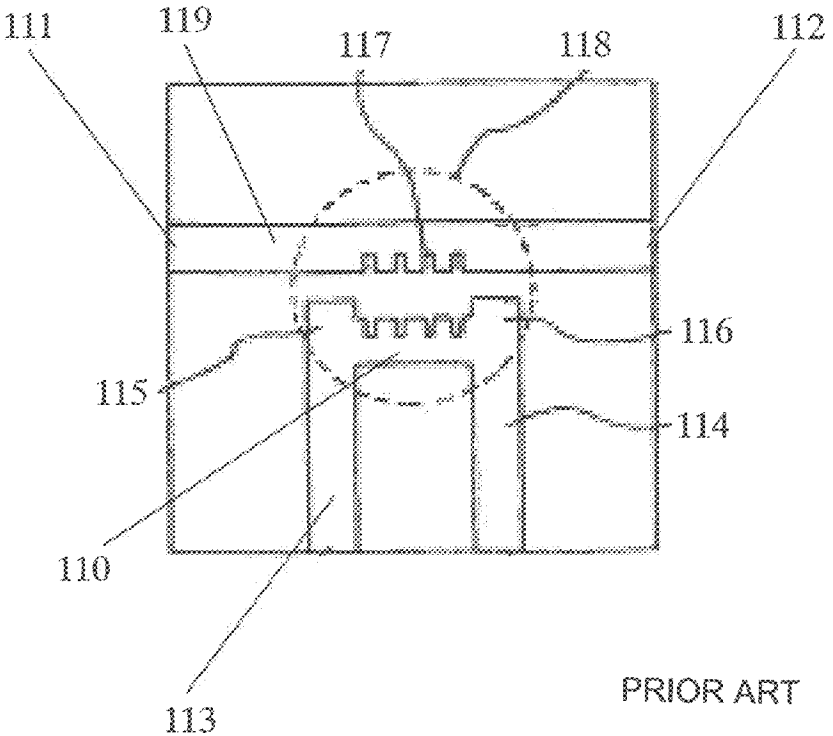
PRIOR ART FIG. 11
FIG. 11 is a schematic diagram of a conventional directional coupler according to Patent Document 1.
Figure 12:
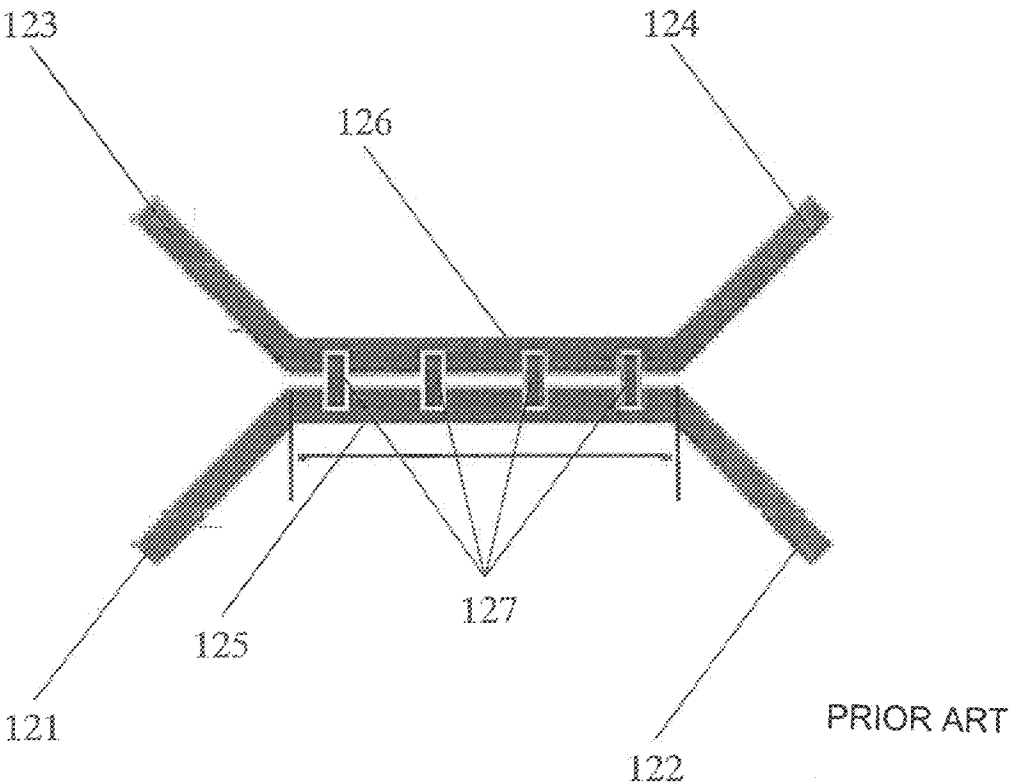
FIG. 12 is a schematic diagram of a conventional directional coupler according to Non-patent Document 2.

FIG. 9 are diagrams illustrating a result of computation of the directionality and the phase difference of the directional coupler in Embodiment 3 of the present invention. More specifically, FIG. 9(*a*) illustrates a graph indicating a result of computation of the amplitude difference (i.e., the directionality) and the phase difference between the coupling port and the isolation port with respect to a length of the directional coupler body for each of the ¼ wavelength directional coupler and the 1/32 wavelength directional coupler.

In addition, FIG. 9(*b*) is a table showing values of a result of the graph illustrated in FIG. 9(*a*). It is clear from FIGS. 9(*a*) and 9(*b*) that frequency dependencies of the amplitude difference and the phase difference are decreased by using the directional coupler of a wavelength shorter than or equal to the ¼ wavelength. Thus, in the directional coupler of Embodiments 1 to 3, it is possible to widen the frequency band in which a good directionality can be obtained.

In addition, as exemplified in Embodiments 1 and 2, the combiner and the directionality improving circuit can be formed on the same plane by using the Wilkinson distributor as the combiner.

In addition, as the combiner used in Embodiments 1 to 3 described above, a branch line hybrid circuit may be used, in which the ¼ wavelength line is added to the coupling port side. Thus, the combiner and the directionality improving circuit can be formed on the same plane.

Further, it is possible to connect attenuators having the same attenuation amount additionally to both the coupling port and the isolation port of the directional coupler body. Thus, it is possible to suppress multiple reflection due to impedance mismatch between the directional coupler body and the combiner.

In addition, it is possible to connect amplifiers having the same gain additionally to both the coupling port and the isolation port of the directional coupler body. Thus, it is possible to suppress multiple reflection due to impedance mismatch between the directional coupler body and the combiner.

The invention claimed is:

1. A directional coupler, comprising:

a directional coupler body including four terminals of an input port, an output port, a coupling port, and an isolation port; and a combiner for combining powers of an output signal of the coupling port and an output signal of the isolation port of the directional coupler body, wherein:

the directional coupler further comprises a directionality improving circuit for amplifying or attenuating at least one of the output signal of the coupling port and the output signal of the isolation port before outputting the same; and the combiner combines powers of the output signals amplified or attenuated by the directionality improving circuit.

2. The directional coupler according to claim 1, wherein:

the directionality improving circuit includes an attenuator having an amplitude value that has the same directionality as the directional coupler body as an attenuation amount, in order to attenuate the output signal from the isolation port before outputting the same; and the combiner combines powers of the output signal from the coupling port and the output signal attenuated by the attenuator.

3. The directional coupler according to claim 1, wherein:

the directionality improving circuit includes an amplifier having an amplitude value that has the same directionality as the directional coupler body as a gain, in order to amplify the output signal from the coupling port before outputting the same; and the combiner combines powers of the output signal from the isolation port and the output signal amplified by the amplifier.

4. The directional coupler according to claim 1, wherein the combiner combines powers of the output signal from the coupling port and the output signal from the isolation port by using an amplitude value that has the same directionality as the directional coupler body as a combining ratio, so as to include the directionality improving circuit.

5. The directional coupler according to claim 1, wherein the directional coupler body is constituted of microstrip lines.

6. The directional coupler according to claim 1, wherein the combiner is a Wilkinson distributor.

7. The directional coupler according to claim 1, wherein the combiner is constituted of a branch line hybrid circuit in which a ¼ wavelength line is added as a line for receiving the output signal from the coupling port.

8. The directional coupler according to claim 1, wherein the directional coupler body is constituted of a ¼ wavelength directional coupler or a ½ wavelength directional coupler.

9. The directional coupler according to claim 1, wherein an isolator is connected to at least one of the coupling port and the isolation port.

10. The directional coupler according to claim 1, wherein attenuators having the same attenuation amount are connected respectively for attenuating both the output signal from the coupling port and the output signal from the isolation port.

11. The directional coupler according to claim 1, wherein amplifiers having the same gain are connected respectively for amplifying both the output signal from the coupling port and the output signal from the isolation port.

12. The directional coupler according to claim 1, further comprising a phase adjustment line connected to at least one of the coupling port and the isolation port, so as to adjust a phase difference between a phase of the signal outputted from the coupling port to be received by the combiner and a phase of the signal outputted from the isolation port to be received by the combiner.

13. The directional coupler according to claim 2, wherein the attenuator is constituted of a combination of a plurality of attenuators, so as to have the amplitude value that has the same directionality as the directional coupler body as the attenuation amount by combining the plurality of attenuators.

14. The directional coupler according to claim 1, wherein a filter circuit is connected to at least one of the coupling port and the isolation port.

15. The directional coupler according to claim 1, wherein the directional coupler body is constituted of a directional coupler including a coupling line of ¼ wavelength or shorter.

* * * * *